US005425508A

United States Patent [19]

Chaney

[11] Patent Number: 5,425,508

[45] Date of Patent: Jun. 20, 1995

[54] HIGH FLOW, LOW INTENSITY PLATE FOR DISC REFINER

[75] Inventor: Michael R. Chaney, Brookfield, Wis.

[73] Assignee: Beloit Technologies, Inc., Wilmington, Del.

[21] Appl. No.: 197,918

[22] Filed: Feb. 17, 1994

[51] Int. Cl.[6] ..... B02C 7/12

[52] U.S. Cl. ..... 241/261.2; 241/296

[58] Field of Search ..... 241/244, 260, 261.2, 241/261.3, 296, 297, 298

[56] References Cited

U.S. PATENT DOCUMENTS

| | | | |
|---|---|---|---|
| 246,906 | 9/1881 | Phillips | 241/296 X |
| 259,974 | 6/1882 | Burns | 241/296 X |
| 269,015 | 12/1882 | Conklin | 241/296 |
| 499,714 | 6/1893 | Corning | 241/296 |
| 1,114,339 | 10/1914 | Bryant | 241/296 |
| 1,169,228 | 1/1916 | Barker | 241/296 |
| 1,187,360 | 6/1916 | Martin | 241/296 |
| 1,609,717 | 12/1926 | Holland-Letz | 241/261.3 |
| 2,779,251 | 8/1953 | Murphy . | |
| 2,934,278 | 4/1960 | Roberson . | |
| 3,118,622 | 2/1962 | Jones . | |
| 3,149,792 | 9/1964 | Textor | 241/261.3 |
| 3,305,183 | 6/1967 | Morden . | |
| 3,323,732 | 6/1967 | Dalzell, Jr. et al. . | |
| 3,326,480 | 6/1967 | Jones . | |
| 3,880,368 | 4/1975 | Matthew . | |
| 4,005,827 | 2/1977 | Frair et al. . | |
| 4,036,443 | 7/1977 | Saltarelli . | |
| 4,529,137 | 7/1985 | Matthew et al. . | |
| 4,531,681 | 7/1985 | Matthew et al. . | |
| 4,570,862 | 2/1986 | Kirchener . | |
| 4,586,662 | 5/1986 | Goldenberg et al. . | |
| 4,614,309 | 9/1986 | Goldenberg . | |
| 4,619,414 | 10/1986 | Kirchner et al. . | |
| 4,620,675 | 11/1986 | Kirchner . | |
| 4,625,926 | 12/1986 | Kirchner . | |
| 5,046,672 | 9/1991 | Demler . | |
| 5,165,592 | 11/1992 | Wasikowski . | |
| 5,178,339 | 1/1993 | Pilao . | |
| 5,181,664 | 1/1993 | Kohler | 241/261.3 |
| 5,203,514 | 4/1993 | Mokvist et al. . | |

*Primary Examiner*—Timothy V. Eley
*Attorney, Agent, or Firm*—Dirk J. Veneman; Raymond W. Campbell

[57] ABSTRACT

The refiner plate for a low consistency pulp refiner has a multiplicity of curved bars or zig-zag bars, or a combination of the two. The operation of a disc refiner causes a rapid and frequent flexure over a brief time period of the individual fibers in a pulp mass, with the result that the bond between the various concentric lamellae comprising an individual fiber are broken down or delaminated to a controlled, desired extent. The individual bars which traverse a surface of the rotating and fixed plates dissipate the power supplied by the central shaft to the rotating plate. The multiplicity of curved bars or zig-zag bars, or a combination of the two have a longer bar length, and therefore lower the power dissipation per bar and per bar unit length. The flow of pulp containing the fiber also generally follows the channels between the bars so that longer bar path length results in longer residence time. Thus, the result of curved or zig-zag bars is a more gentle refining action which continues over a longer time. Curving the refiner bars causes them to function better as a pump.

8 Claims, 5 Drawing Sheets

HIGH FLOW, LOW INTENSITY PLATE FOR DISC REFINER

FIELD OF THE INVENTION

This invention relates to low consistency refiners in general and to rotary refiners in particular.

BACKGROUND OF THE INVENTION

Disc refiners are used in the paper manufacturing industry to prepare the cellulose fibers of a paper pulp into a desired condition prior to delivering the pulp to the papermaking machine. In operation, a disc refiner is generally considered to exert a type of abrasive action upon individual fibers and the pulp mass so that the outermost layers of the individual cigar-shaped fibers are frayed. This facilitates the bonding of the fibers.

The fibers are relatively slender, tube-like structural components made up of a number of concentric layers. Each of these layers (called "lamellae") consists of finer structural components (called "fibrils") which are helically wound and bound to one another to form the cylindrical lamellae. The lamellae are in turn bound to one another, thus forming a composite which, in accord with the laws of mechanics, has distinct bending and torsional rigidity characteristics. A relatively hard outer sheath (called the "primary wall") encases the lamellae. The primary wall is often partially removed during the pulping process. The raw fibers, which are relatively stiff and have relatively low surface area when the primary wall is intact, inhibit bond formation and as a result limit the strength of the paper formed from these fibers.

It is generally accepted that it is the purpose of a pulp stock refiner, which is essentially a milling device, to remove the primary wall and break the bonds between the fibrils of the outer layers to yield a frayed surface, and thereby increase the surface area of the fiber multifold. The operation of disc refiners is also generally considered to cause a rapid, frequent flexure over a brief time period of the individual fibers in the pulp mass. This flexing renders the fibers more flexible. This in turn allows the fibers to conform to each other and produce larger areas of intimate contact.

It is the purpose of a stock refiner to modify the fibers in accordance with the above requirements without significantly reducing the length or individual strength of these fibers. U.S. Pat. No. 3,880,368 to Matthew discloses the benefit of repeatedly and gently refining the pulp to ensure that fibers are not extensively damaged. Matthew points out the impracticability of avoiding all fiber damage, and suggests the reduction of fiber damage through the use of plastic or low-modulus materials for the construction of refiner discs.

Matthew also suggests that gentle refining can be accomplished by the use of many blades per plate and operating at relatively high speeds. However, the use of many blades or bars on the plates reduces the flow area. This can reduce the through-put, decreasing the efficiency and increasing the costs of the refining process.

U.S. Pat. No. 3,305,183 to Morden shows curved bars on a the interior of a frustoconical shell refiner section and suggests such bars could be used on refiners of nonfrustoconical shape. Morden does not disclose how to use curved bars on flat plates to obtain the benefits of more gentle refining and higher throughput.

What is needed is a disc refiner that improves through-put with a refining action that is less damaging to individual paper fibers.

SUMMARY OF THE INVENTION

The refiner plate of this invention employs a multiplicity of curved bars or zig-zag bars, or a combination of the two. In a disc refiner, low consistency pulp of two to five percent fiber dry weight is passed between a rotating plate and a stationary plate. The disc plates are typically twenty to fifty-four inches in diameter and the pulp is typically fed axially at twenty to eighty PSI pressure through the interface between the moving and non-moving plates. The gap between the moving and non-moving disc plates is typically three to eight thousandths of an inch.

In one configuration of a disc refiner, two rotating refiner plates are mounted on a rotor which is spaced between parallel non-moving refiner plates. Hydrodynamic forces center the rotor and the rotating plates between the stationary refiner plates. The rotor is typically mounted on a shaft which is moveable along the axis of rotation. The spacing between the rotating refiner plates and the stationary refiner plates is adjusted by a mechanism which moves the two stationary plates towards each other, while the rotor is kept centered by hydro-dynamic forces and its freedom to move along its rotational axis.

As the stock flows between the rotating and stationary refiner plates individual fibers in the pulp mass experience a species of abrading action with the result that the side outermost layers of the individual cigar-shaped fibers are frayed, thereby increasing the surface area of the fibers greatly.

The operation of a disc refiner is also generally considered to cause a rapid and frequent flexure over a brief time period of the individual fibers in a pulp mass, with the result that the bond between the various concentric lamellae comprising an individual fiber are broken down or delaminated to a controlled, desired extent.

The individual bars which traverse a surface of the rotating and fixed plates dissipate the power supplied by the central shaft to the rotating disc. Therefore, the more bars and the longer the bar length, the lower the power dissipation per bar and per bar unit length. The flow of pulp containing the fiber also generally follows the channels between the bars so that longer bar path length results in longer residence time. Thus, the result of curved or zig-zag bars is a more gentle refiner action which continues over a longer time. Curving the refiner bars causes them to function better as a pump.

It is an object of the present invention to provide a refiner plate for a low consistency refining which permits increased throughput with reduced fiber damage.

It is also an object of the present invention to provide a refiner which effectively frays treated fibers.

It is an additional object of the present invention to provide a refiner plate for a low density refiner which refines fibers with reduced intensity.

Further objects, features, and advantages of the invention will be apparent from the following detailed description when taken in conjunction with the accompanying drawings.

DESCRIPTION OF THE PREFERRED EMBODIMENTS

Figure 1:
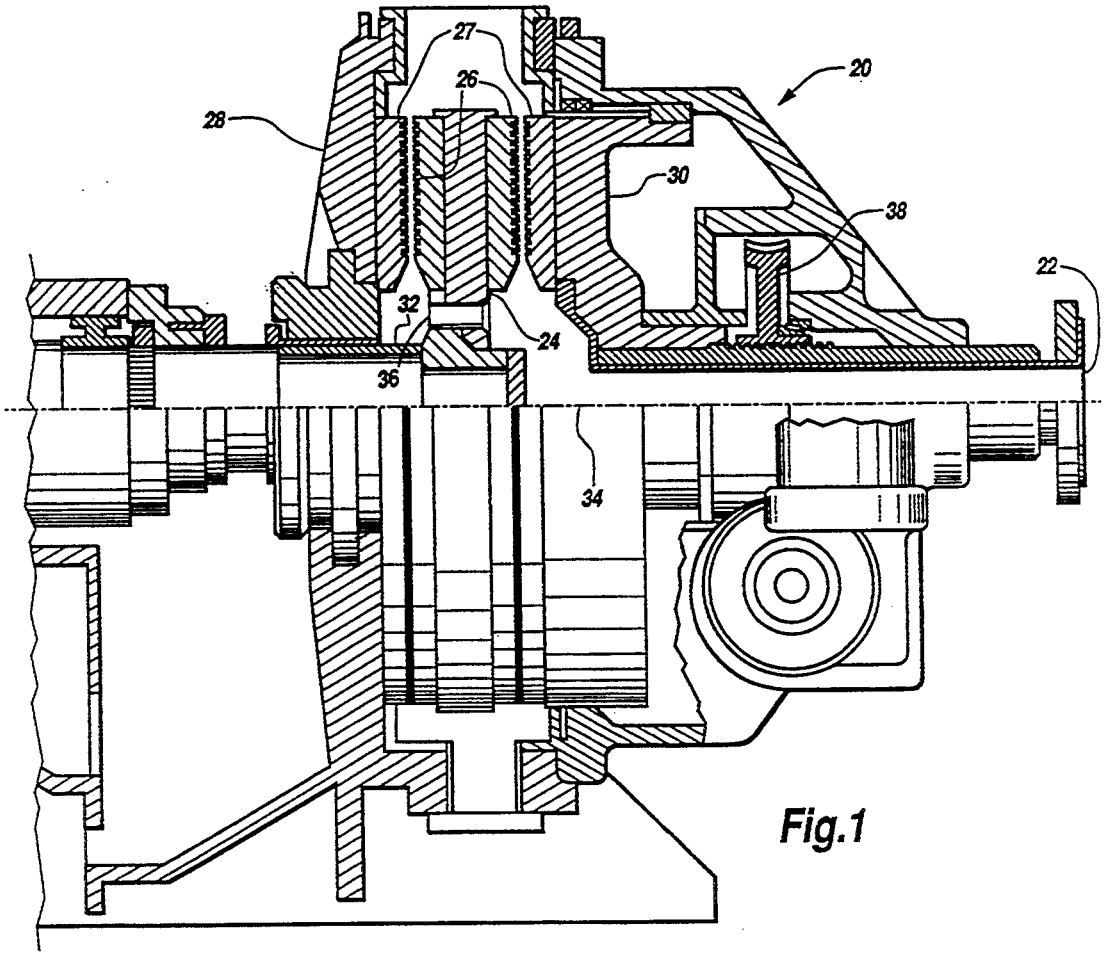
FIG. 1 is a fragmentary, partially cut-away view of a refiner employing the refiner plates of this invention.

Referring more particularly to FIGS. 1–5, wherein like numbers refer to similar parts, a Duo-Flo configured disc refiner 20 is shown in FIG. 1. The disc refiner 20 has a stock inlet 22 through which papermaking stock consisting of two to five percent fiber dry weight in water is pumped, typically at a pressure of twenty to forty PSI. The refiner has a moving rotor 24. Refiner plates 26 are mounted on the rotor 24. Refiner plates 27 are also mounted to a non-moving head 28 and a sliding head 30. The refiner plates 27 which are mounted to the non-moving head 28 and the sliding head 30 are opposed and closely spaced from the refiner plates 26 on the rotor 24.

The rotor 24 is mounted to a shaft 32. The shaft 32 is mounted so that the rotor 24 may move axially along the axis 34 of the shaft. The rotor has passage ways 36 which allow a portion of the stock to flow through the rotor 24 and pass between the refiner plates 26, 27 which are opposed between the rotor and the stationary head 28. A portion of the stock also passes between the refiner plates 26, 27 mounted on the rotor and on the sliding head 30.

In operation, the gap between the refiner plates 26 mounted on the rotor 24 and the refiner plates 27 mounted on the non-rotating heads 28 and 30 is typically three- to eight-thousandths of an inch. The dimensions of the gaps between the refiner plates 26, 27 are controlled by first positioning the rotor between the non-moveable head 28 and the sliding head 30; stock is then fed to the refiner 20 and passes between the rotating and non-rotating refiner plates 26, 27, establishing hydrodynamic forces between the rotating and non-rotating refiner plates; the rotor is then released so that it is free to move axially along the axis 34 by means of the slidable shaft 32. The rotor 24 seeks a hydrodynamic equilibrium between the non-rotating heads 28 and the sliding head 30. The sliding head 30 is rendered adjustable by a gear mechanism 38 which slides the sliding head 30 towards the stationary head 28. The hydrodynamic forces of the stock moving between the stationary and rotating refiner plates 26, 27 keeps the rotor centered between the stationary head 28 and the sliding head 30, thus assuring a uniform, closely spaced gap between the stationary and rotating refiner plates 26, 27.

As individual stock fibers flow between the rotating and stationary refiner plates 26, 27, the fibers are subjected to abrading action. The result of this abrasion is that the sidemost layers of the individual, cigar-shaped fibers are frayed, greatly increasing the surface area and bonding capability of the fibers. The operation of the disc refiner 20 also causes a rapid and frequent flexure of the individual fibers in the pulp mass, with the result that the fibers are rendered more flexible. This improves the capacity of the fibers to be brought into intimate contact and form a better bond. Thus, the refining process produce paper fibers capable of forming paper of greater strength and tear-resistance.

Figure 2:
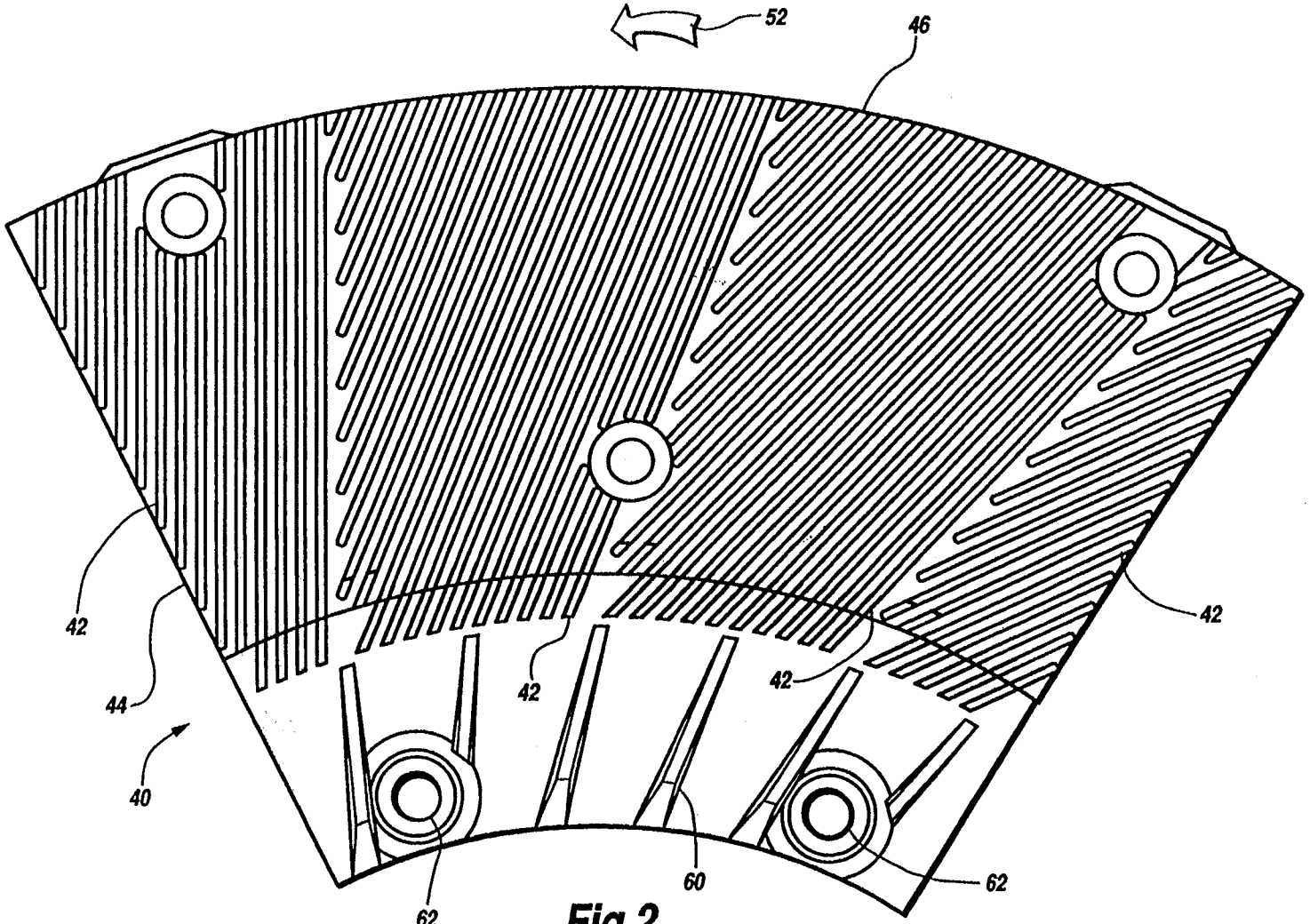
Fig.2 (PRIOR ART)
FIG. 2 is a plan view of a segment of a prior art refiner plate for a disc refiner.

A conventional prior art refiner plate section 40 is shown in FIG. 2. The prior art refiner plate 40 has arrays of protruding refining bars 42 grouped in sets of straight parallel bars 42 and grooves 44 arranged in repeating fields 46. Another type of prior art refiner plate (not shown) has straight, radially extending bars and grooves.

The design of refiner plates requires recognition of criteria for improving the performance of the plates. The first of these design criteria is the km/rev. This criteria is a measure of the total length of cutting edges on bars on a given plate. The desirability of increasing the total length of the bars on the plate is understood in terms of the desirability of causing the abrasion of the pulp fibers with as low an intensity as possible. The power consumed by the disc refiner 20 is dissipated over the area of the refiner plates 26, 27. By increasing the total length of the bars or the number of the bars, the amount of power dissipated per unit length of bar is decreased. In general, the longer the length of the individual bars, the longer the length of the individual grooves, and hence the longer the residence time of the fiber as it passes through the refiner 20. Because power dissipation is proportional to the abrasion action, the net result of longer bar length is that the abrasion takes place over a longer period of time and is thus of lower intensity. Lower intensity results in fewer cut or damaged fibers caused by excessive abrasive action.

Another important design consideration is the amount of restriction of flow at the inside diameter and outside diameter of the refiner plate. Although a number of factors effect the openness of flow, the restriction is generally correlated with the amount of open area on the inside diameter and on the outside diameter. By open area is meant the spacing between bars times the height of the bars. Open area on the inside and outside diameters is important to achieve flow through the disc refiner. Higher flow improves productivity and lowers costs of processing wood fibers through the refiner 20. It is also important that the bar patterns of the refiner plate result in most fibers being brought to the bar surface where the desirable fraying of fibers can take place. Fibers which reside within a groove between bars and channel out the entire length of the plate without passing over the tops of the bars do not benefit from the refining processing.

In prior art refiner plates, improvements in one performance aspect have often resulted in decreased acceptability in view of the other criteria. For example, the prior art refiner plate 40, in FIG. 2, achieves relatively unrestricted inside diameter and outside diameter open area, that is high open area. However, the prior art design achieves less km/rev than other prior art designs such as the completely radial bar design. On the other hand, the radial bar designs are limited by the restrictive area of the inside diameter of the refiner plate.

Figure 3:
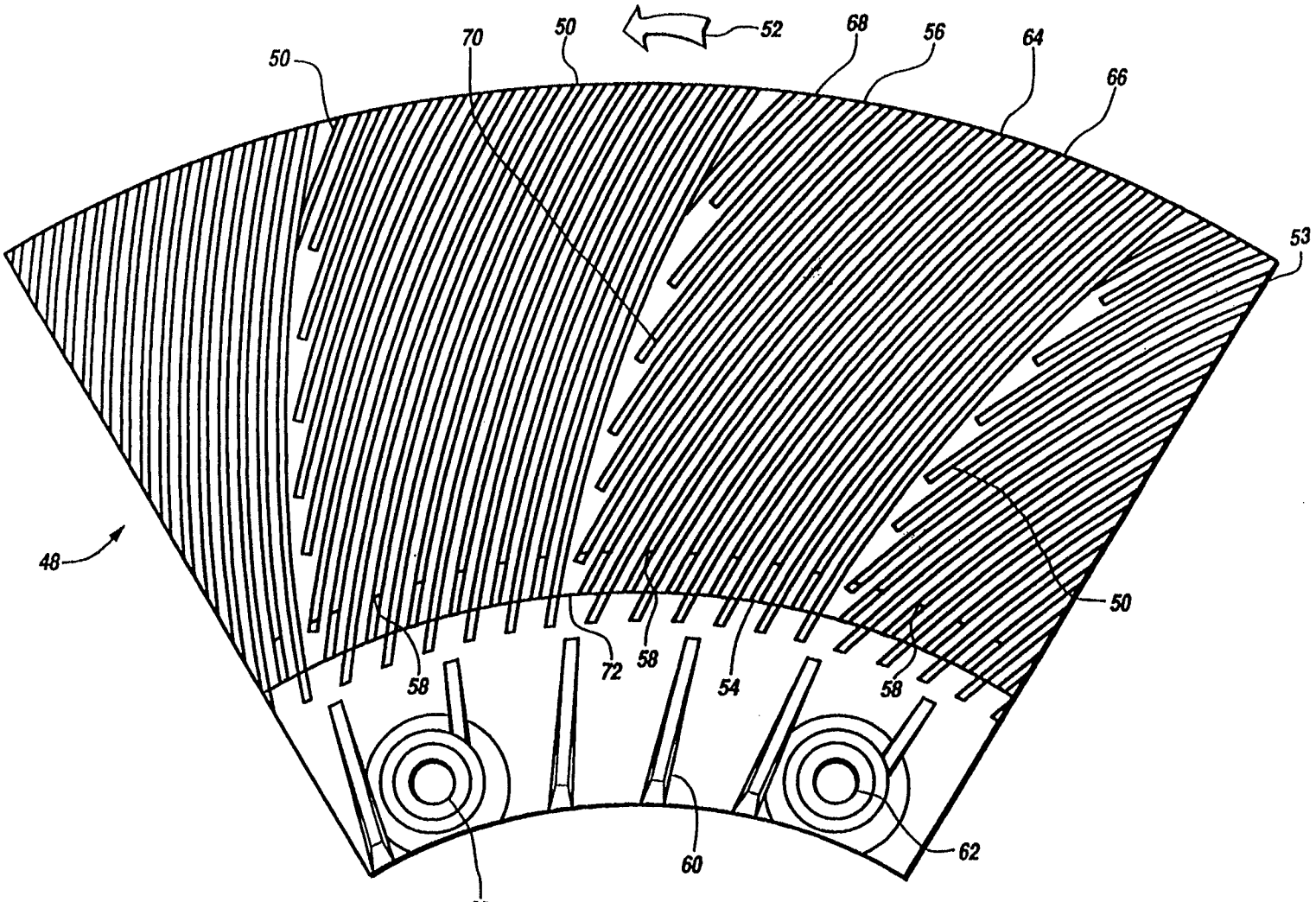
FIG. 3 is plan view of a segment of a refiner plate for the disc refiner of this invention.

The refiner plate 48 of this invention, shown in FIG. 3, has bars 50 which curve gently away from the direction of rotation as shown by the arrow 52. The bars 50 protrude axially from an annular base section 53. The base section 53 may be a complete annulus, or may be formed from an assembly of multiple sectors. The curved bars 50 yield an improved km/rev which is expected to result in a more gentle refining action. Curving the bars in a fashion similar to the vanes on a pump impeller will serve to pump the stock through the plate 48, thus improving through-put.

The refiner section 48 addresses the need to have fibers flow over the bars as well as down the channels in order to be refined by the plate 48. In prior art refiner plates, dams have been positioned between the bars to force the flow of stock out of the channels. Dams cause problems with plate plugging and can cause too much fiber cutting. The gentle curved bars 50 of plate 48 will gently block the completely radial flow of the stock which is driven radially by a centrifugal force, thus causing the stock to flow out of the channels and over the bars 50 where the stock is refined.

The curved bars 50 result in a relatively unrestricted inside diameter, while offering a somewhat more restricted flow at the outside diameter 56. To increase the inside diameter openness, the refiner plate 48 is provided with interior chamfers 58 on the curved bars 50 which extend to the inside diameter 54 to increase the inside diameter flow area. By chamfering the interior portions of the bars, the obstruction to flow is reduced and an increased openness obtained at the inside diameter. In one example found to operate successfully, the bars on the refiner plate 48 have a height of 0.312 inches and a bar width of 0.125 inches. The groove width is 0.188 inches. Thus, the groove is fifty percent wider than the bars. Acceptable bar height will fall in the range of from 0.187 inches to 0.312 inches, bar width from 0.090 inches to 0.250 inches and groove width from 0.090 inches to 0.250 inches.

As shown both in the prior art refiner plate 40 in FIG. 2 and the refiner plate 48 in FIG. 3, vanes 60 are positioned radially inwardly of the refiner bars 42, 50 which help to accelerate and propel the stock outward and into the refiner bars 42, 50. Adjacent to the vanes 60 are attachment holes 62, whereby the plates 40, 48 can be bolted or screwed to the rotor 24 of a disc refiner 20. Similarly, they may be attached to the non-moving head 28 or the sliding head 30.

The refiner plate 48 has repeating fields of curved bars 50. The repeating fields 64 are composed of two types of bars 50: full length bars 66 which extend all the way from the inside diameter 54 to the outside diameter 56, and shorter bars 68 which are positioned in the pattern 64 as the radius of the plate 48 increases. The radially outward regions of the plate have a greater periphery, and thus provide additional space for the addition of the shorter length curved bars 68. The grooves 70 are defined adjacent the shorter bars 68. The shorter grooves 70 receive stock not only from the channels 72 which extend to the interior diameter 54, but also from the flow of stock over adjacent bars 50.

Figure 4:
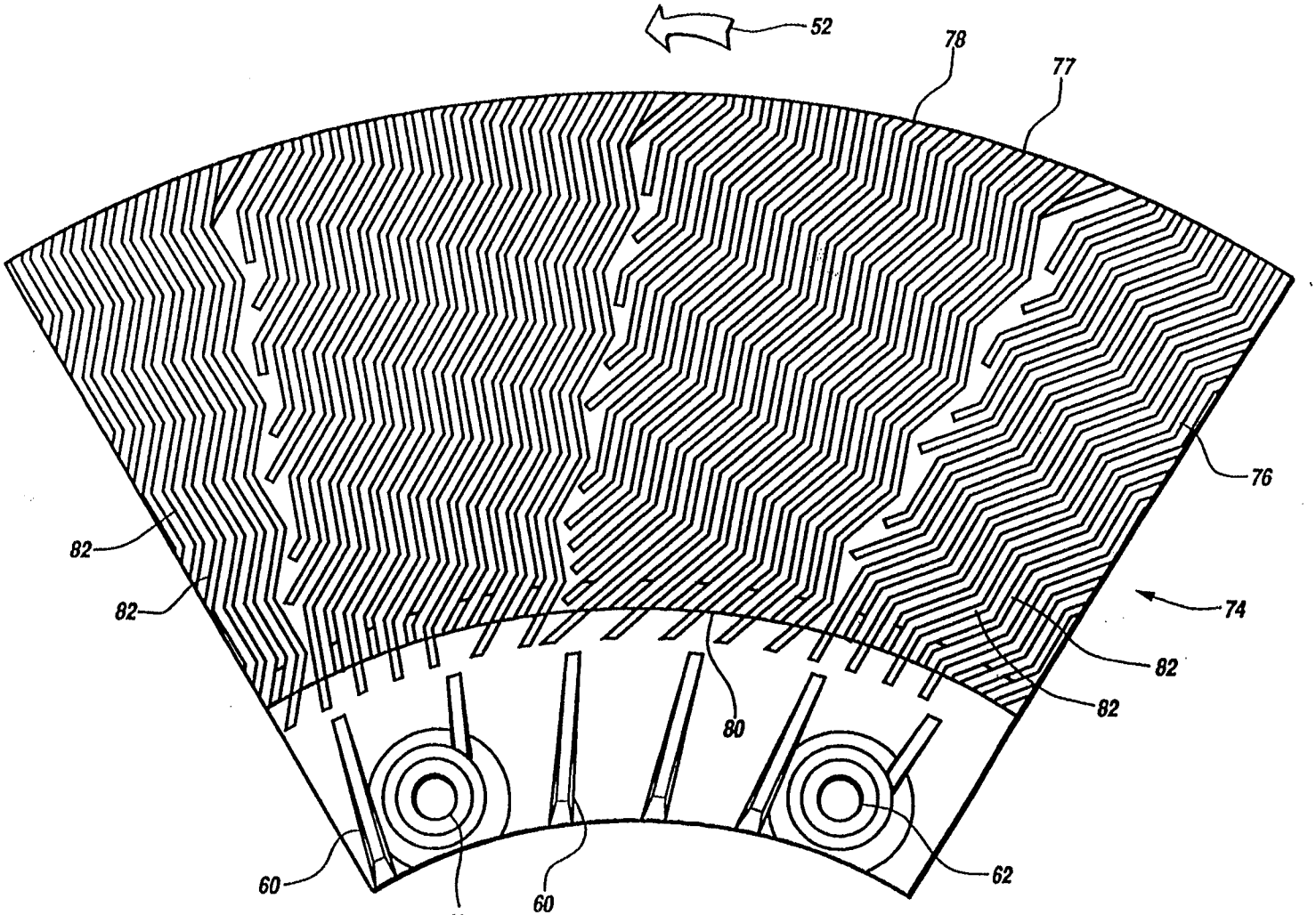
FIG. 4 is a plan view of an alternative embodiment of the refiner plate for a disc refiner of this invention.

An alternative embodiment refiner plate 74 of this invention is shown in FIG. 4 which has refiner bars 76 with a zig-zag pattern. Each refiner bar 76 has a zig-zag configuration which comprises a plurality of parallel segments extending in a first direction which are joined by parallel segments extending in a second direction which is at an obtuse angle to the first direction. The zig-zag refiner bars protrude axially from an annular base section 77. The zig-zag pattern has a greater km/rev than the prior art configuration of FIG. 2. It also has an outside diameter 78 with a greater open area than the outside diameter 56 of the plate configuration 48 of FIG. 3. The inside diameter 80 of the plate 74 has a slightly reduced open area which is somewhat more restrictive than the inside diameter 54 of the curved bar plate 48 of FIG. 3. The zig-zag plate 74 has short sections of bars 82 which are connected at an obtuse angle to successive short sections 82, thus forming a jagged pathway for the flow of pulp fibers. This jagged pathway formed by the short bar segments 82 increases the residence time of fibers as they flow from the inside diameter 80 to the outside diameter 78. The zig-zag sinuous pathway also tends to make fibers flow over the bars where they are subjected to the abrasion action which is characteristic of the disc refiner process.

Figure 5:
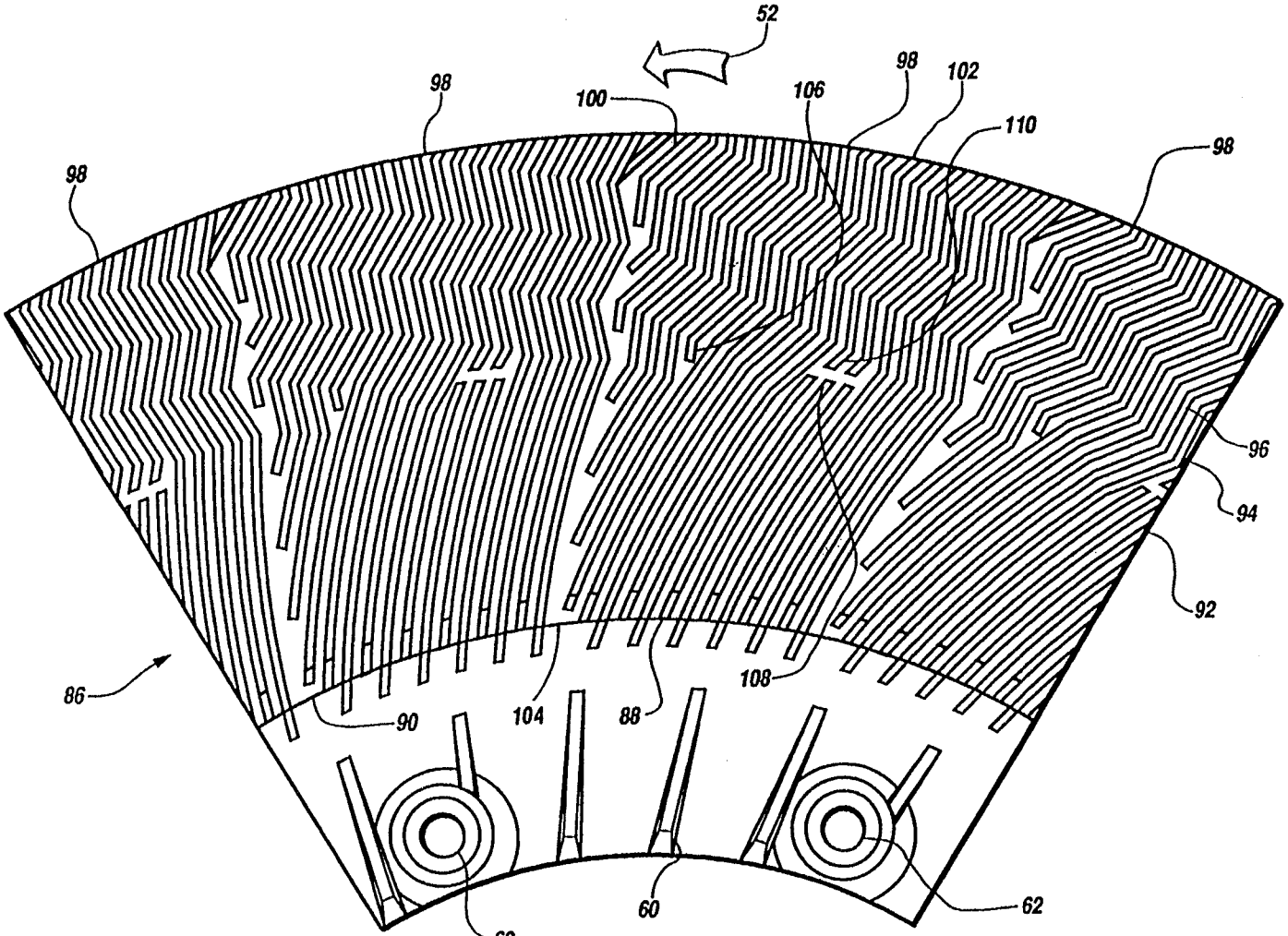
FIG. 5 is plan view of another alternative embodiment of the refiner plate for a disc refiner of this invention.

Another alternative embodiment disc refiner plate 86 is shown in FIG. 5 which combines features of the curved bar disc refiner plate 48 and the zig-zag disc refiner plate 74. The refiner plate 86 has gently curved bars 88 which protrude from a base section 92. The refiner bars 88 begin near the inside diameter 90 and extend radially outwardly approximate one half of the radial width of the base section 92. The outer sections 94 of bars are zig-zag bars 96 which continue to the outside diameter 98.

The refiner plate 86 has a km/rev intermediate between that of the refiner plate 48 of FIG. 3 and the refiner plate 74 of FIG. 4, but has a relatively open inside diameter 88 as does the curved bar plate 48 of FIG. 3 while also having a relatively open outside diameter 98 as does zig-zag plate 74 of FIG. 4. Thus, the refiner plate 86 of FIG. 5 combines the benefits of the refiner plates 48 and 74. This refiner plate has higher capabilities while at the same time a more gentle refining action which results in fewer cut or damaged paper fibers.

The repeating field of bars 98 of the refiner plate 86 employs not only short bars 100 which are added to the long bars 102 along the channel 104, but also includes a short zig-zag bar 106 which is positioned between a long bar 102 and a short bar 100. Further, at least one location within the field of bars 98, three curved bars 108 transition to two zig-zag bars 110. This provides the optimally filled field 98 for maximum km/rev, consistent with the employment of zig-zag bars 96.

It should be understood that the width and height of the individual bars on the refiner plates 48, 74 and 86 could be varied, thus employing bars of differing heights and thicknesses together with grooves of different widths than those illustrated and described.

It should also be understood that the refiner plates 48, 74 and 86 could be employed with disc refiners of configuration other than that shown in FIG. 1.

Further, it should be understood that curved bars 50 could be combined with the zig-zag bars 76 so that the transition from one bar type to another occurred at a radial position other than that shown in the refiner plate 86 of FIG. 5.

It should be understood that the invention is not limited to the particular construction and arrangement of parts herein illustrated and described, but embraces such modified forms thereof as come within the scope of the following claims.

I claim:

1. A refiner plate for a paper pulp refiner for mechanically treating pulp fibers to alter physical characteristics of the fibers, the plate comprising:

a base section having an inside diameter and an outside diameter, wherein the base section is mounted for rotation within a refiner, and wherein the base section extends radially within the plane of rotation; and a plurality of sets of refiner bars which refiner bars protrude axially from the base section and extend in a curve in a generally radial direction, wherein each set of neighboring refiner bars define curved grooves which curve along their length as they extend from the inside diameter toward the outside diameter, and wherein more bars extend to the outside diameter than extend from the inside diameter;

each set of refiner bars is so arranged as to be angularly offset relative to the set of refiner bars on either side thereof such that the refiner bars all curve in the direction away from the intended direction of rotation of the refiner plate, and the refiner bars on the upstream side of each set of refiner bars, relative to the intended direction of rotation, comprise the ones of the set of refiner bars which do not extend from the inside diameter to the outside diameter.

2. The refiner plate of claim 1 wherein the refiner bars comprise a plurality of long curved bars which extend from the inside diameter to the outside diameter, and a plurality of shorter refiner bars having approximately the same curvature as the long curved bars, but which extend from a position intermediate between the inside diameter and the outside diameter to a position at the outside diameter.

3. A refiner plate for a paper pulp refiner for mechanically treating pulp fibers to alter physical characteristics of the fibers, the plate comprising:

a base section having an inside diameter and an outside diameter, wherein the base section is mounted for rotation within a refiner, and wherein the base section extends radially within the plane of rotation; and a plurality of sets of refiner bars which protrude axially from the base section and extend generally outwardly from the inside diameter to the outside diameter in a zig-zag pattern, wherein neighboring refiner bars in each set define zig-zag grooves substantially equally spaced along their length, where some of which refiner bars extend from the inside diameter to the outside diameter, and each set is so arranged as to be angularly offset relative to the intended direction of rotation.

4. The refiner plate of claim 5 wherein the refiner bars comprise a plurality of long zig-zag bars which extend from the inside diameter to the outside diameter, and a plurality of shorter zig-zag refiner bars which extend from a position intermediate between the inside diameter and the outside diameter to a position at the outside diameter.

5. The refiner plate of claim 3 wherein each zig-zag bar comprises a plurality of parallel segments extending in a first direction which are joined by parallel segments extending in a second direction which is at an angle to the first direction.

6. A refiner plate for a paper pulp refiner for mechanically treating pulp fibers to alter physical characteristics of the fibers, the plate comprising:

a base section having an inside diameter and an outside diameter, wherein the base section is mounted for rotation within a refiner, and wherein the base section extends radially within the plane of rotation; and a plurality of refiner bars which protrude axially from the base section and extend radially outwardly, wherein neighboring refiner bars define grooves which extend toward the outside diameter, and wherein some of said bars have a first portion which is curved and extends from the inside diameter, and a zig-zag portion which extends to the outside diameter.

7. The refiner plate of claim 6 wherein each zig-zag bar portion comprises a plurality of parallel segments extending in a first direction which are joined by parallel segments extending in a second direction which is at an angle to the first direction.

8. The refiner plate of claim 6 further comprising a plurality of zig-zag bars which extend from a position intermediate between the inside diameter and the outside diameter to a position at the outside diameter.

* * * * *